US005735778A

United States Patent [19]

Piaget

[11] Patent Number: 5,735,778

[45] Date of Patent: Apr. 7, 1998

[54] EXERCISE APPARATUS INCLUDING AN IMPROVED UPPER BODY EXERCISE DEVICE

[76] Inventor: Gary D. Piaget, 3390 American Saddler Dr., Park City, Utah 84060

[21] Appl. No.: 800,888

[22] Filed: Feb. 13, 1997

[51] Int. Cl.[6] ..... A63B 22/00; A63B 69/06

[52] U.S. Cl. ..... 482/114; 482/51

[58] Field of Search ..... 482/51, 52, 53, 482/54, 56, 57, 114–118, 70, 71, 74, 37, 62, 139; 434/255, 252, 253

[56] References Cited

U.S. PATENT DOCUMENTS

| | | | |
|---|---|---|---|
| 2,621,043 | 12/1952 | Olmstead | 482/114 |
| 3,637,205 | 1/1972 | Bankston | 482/114 |
| 4,529,194 | 7/1985 | Haaheim . | |
| 4,632,385 | 12/1986 | Geraci . | |
| 5,000,443 | 3/1991 | Dalebout et al. . | |
| 5,147,257 | 9/1992 | Loane . | |
| 5,162,029 | 11/1992 | Gerard | 482/54 |
| 5,232,423 | 8/1993 | Hajduczek . | |
| 5,328,427 | 7/1994 | Sleamoker | 482/51 |
| 5,336,141 | 8/1994 | Vittone . | |
| 5,391,129 | 2/1995 | Zaitsev | 482/56 |
| 5,419,747 | 5/1995 | Piaget et al. . | |
| 5,496,235 | 3/1996 | Stevens | 482/52 |
| 5,536,224 | 7/1996 | Hsieh | 434/255 |
| 5,575,740 | 11/1996 | Piaget et al. . | |

*Primary Examiner*—Stephen R. Crow

*Attorney, Agent, or Firm*—Salter & Michaelson

[57] ABSTRACT

A striding-type exercise device includes a unique upper body exercise arrangement. The exercise apparatus includes a frame having spaced upright support arms, two spaced pivotable leg members respectively pivotally mounted to the support arms for providing lower body striding movement and, two spaced, upwardly curved rails respectively mounted to the support members with two grip members respectively slidably mounted on the curved rails for providing upper body exercise. The leg members include platforms for receiving the feet of the user that is positioned between the spaced support members while the grip members are operative for receiving the hands of the user. The grip members are fashioned from a material which provides for a smooth sliding action on the rails. Resistance to movement of the grip members can be provided by physically squeezing the grip members, or alternatively, the grip members may further include a pocket for receiving a sheet of weighted material or a sheet of magnetic material, each of which provides active resistance to sliding movement of the grip members. In use, the leg members are pivotally reciprocated forwardly and rearwardly to simulate the natural stride of the legs during walking, while the grip members are slidably movable along the curved length of said rails to track the swinging arc of the user's arms during reciprocation of the arms. Alternatively, the leg members can be locked in position for use of only the upper body rails, or the user can grasp the handlebar to utilize only the lower body striding apparatus.

28 Claims, 6 Drawing Sheets

EXERCISE APPARATUS INCLUDING AN IMPROVED UPPER BODY EXERCISE DEVICE

BACKGROUND AND SUMMARY OF THE INVENTION

The instant invention relates generally to exercise apparatus, and more particularly to an exercise apparatus including upper and lower body exercise devices.

At the present time, there are literally hundreds of different types of exercise devices which are commercially available for exercising the upper and/or lower body muscle groups. Of the currently available exercise devices, devices which simulate walking or striding are very popular because they are easy to use, and most importantly they have demonstrated significant cardiovascular and aerobic effectiveness for exercising different parts of the body. Of the presently available devices, the apparatus described in the U.S. Patent to Piaget et al, U.S. Pat. No. 5,419,747 represents the closest prior art to the subject invention of which the applicant is aware. The device in the '747 patent is a striding-type device including two leg members and two arm members which are pivotally mounted to upright support members at vertically spaced positions so that the leg members are generally pivotable at the hips of the user and the arm members are generally pivotable at the shoulders of the user. Hydraulic cylinders are connected between the arm and leg members to provide resistance when the arm and leg members are reciprocated in different directions. While the '747 device is highly effective for its intended purpose, there is an ongoing industry need and consumer desire for simpler exercise devices which provide the functionality of proven designs at lower cost.

In this regard, the instant invention provides an exercise device which is highly effective for exercising both upper and lower body muscle groups, and yet is much simpler in construction and less costly to manufacture than other similar devices. The exercise apparatus includes a frame having spaced upright support arms, two spaced pivotable leg members respectively pivotally mounted to the support arms, two spaced, upwardly curved rails respectively mounted to the support arms, and two sliding grip members respectively slidably mounted on the curved rails. The leg members include platforms for receiving the feet of the user that is positioned between the spaced support members, while the grip members are operative for receiving the hands of the user during use. The apparatus still further includes a handlebar which extends between forward portions of the spaced rails for receiving the hands of the user when the upper body exercise device is not being used. The grip members are preferably fashioned from a soft spun polyester material, or other suitable sliding material which provides for a smooth sliding action on the rails as well as providing absorbance and dissipation of sweat from the hands during use. Resistance to movement of the grip members can be provided by physically squeezing the grip members, or alternatively, the grip members may further include a pocket for receiving a sheet of weighted material or a sheet of magnetic materials, each of which provides active resistance to sliding movement of the grip members.

In use, the leg members are pivotally reciprocated forwardly and rearwardly to simulate the natural stride of the legs during walking, while the grip members are slidably movable along the curved length of said rails to track the swinging arc of the user's arms during reciprocation of the arms. Alternatively, the leg members can be locked in position for use of only the upper body rails, or the user can grasp the handlebar to utilize only the lower body striding apparatus.

Accordingly, among the objects of the instant invention are: the provision of an exercise device effective for simultaneously exercising both upper and lower body muscle groups; the provision of an exercise device including a striding-type exercise device for exercising the lower body muscle groups; the provision of an upper body exercise device comprising a pair of spaced, upwardly curved rails and two grip members respectively slidably mounted on the curved rails; the provision of grip members which are fashioned from a soft cloth material to provide smooth sliding of the grips as well as to provide absorbency for sweat during use; and the provision of grip members which include a pocket for receiving a sheet of weighted material or a sheet of magnetic material to provide resistance to sliding movement of the grip member along the rail.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE PREFERRED EMBODIMENT

Figure 1:
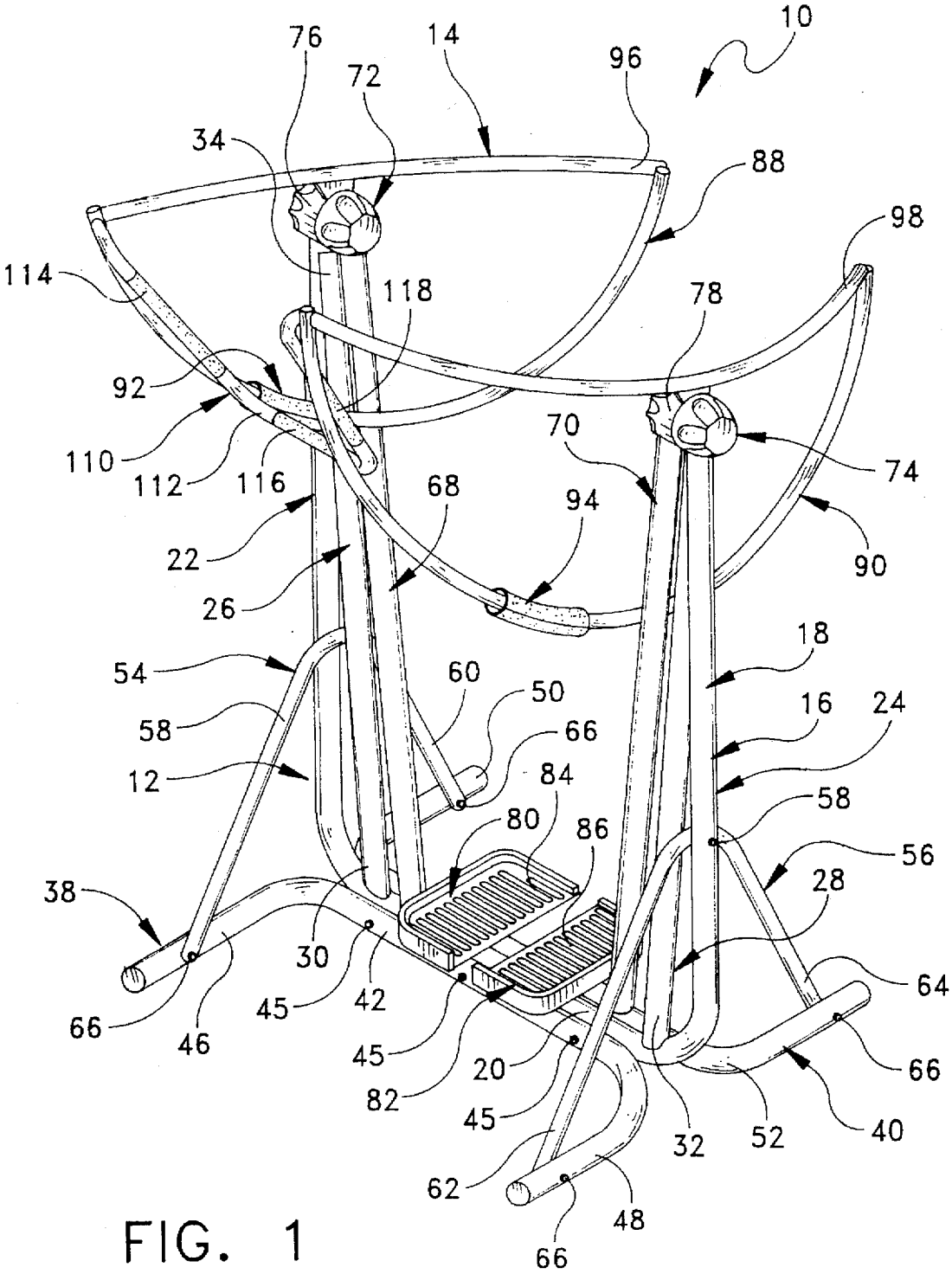
FIG. 1 is a perspective view of the instant exercise device.
Figure 2:
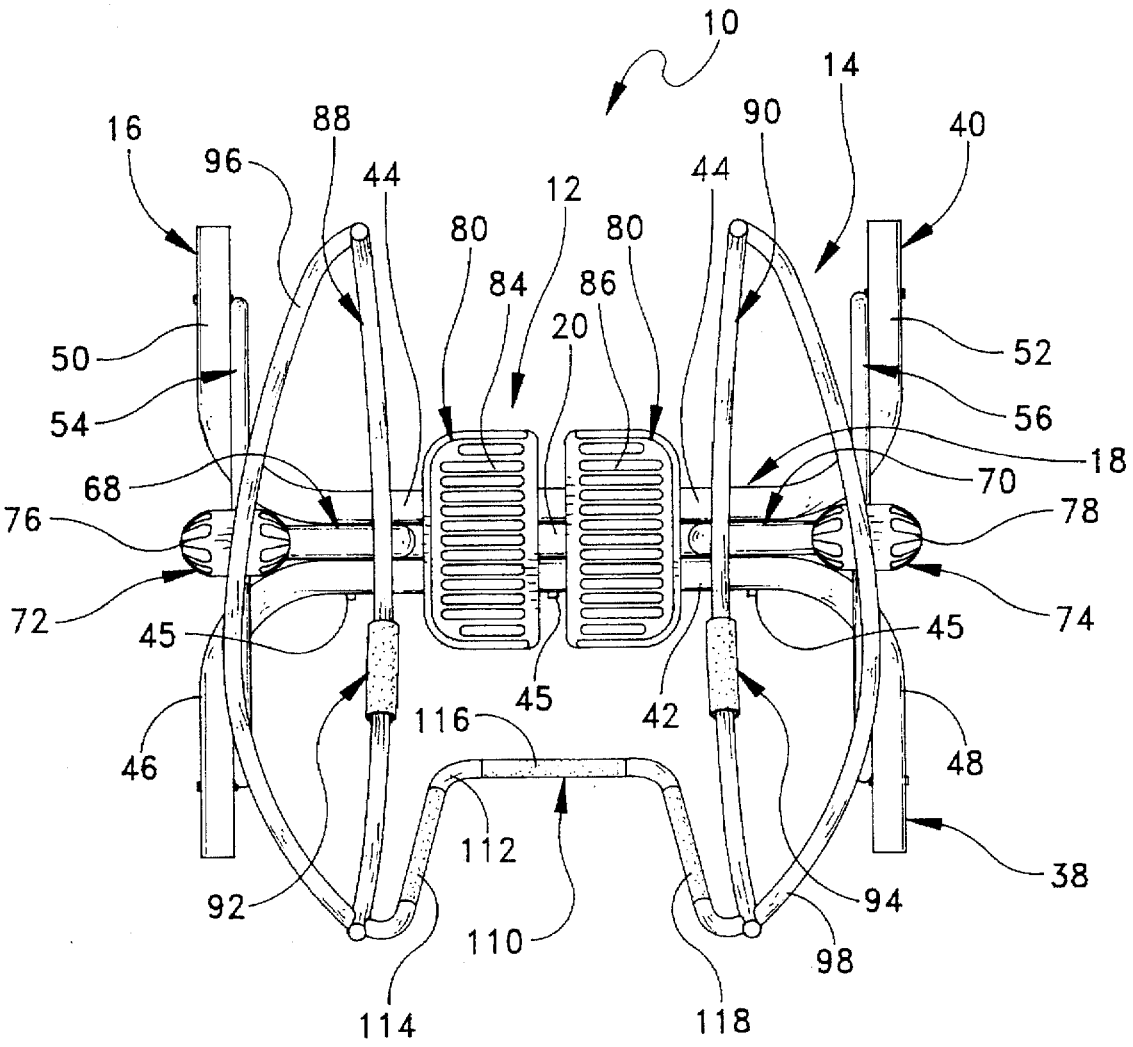
FIG. 2 is a top view thereof.
Figure 3:
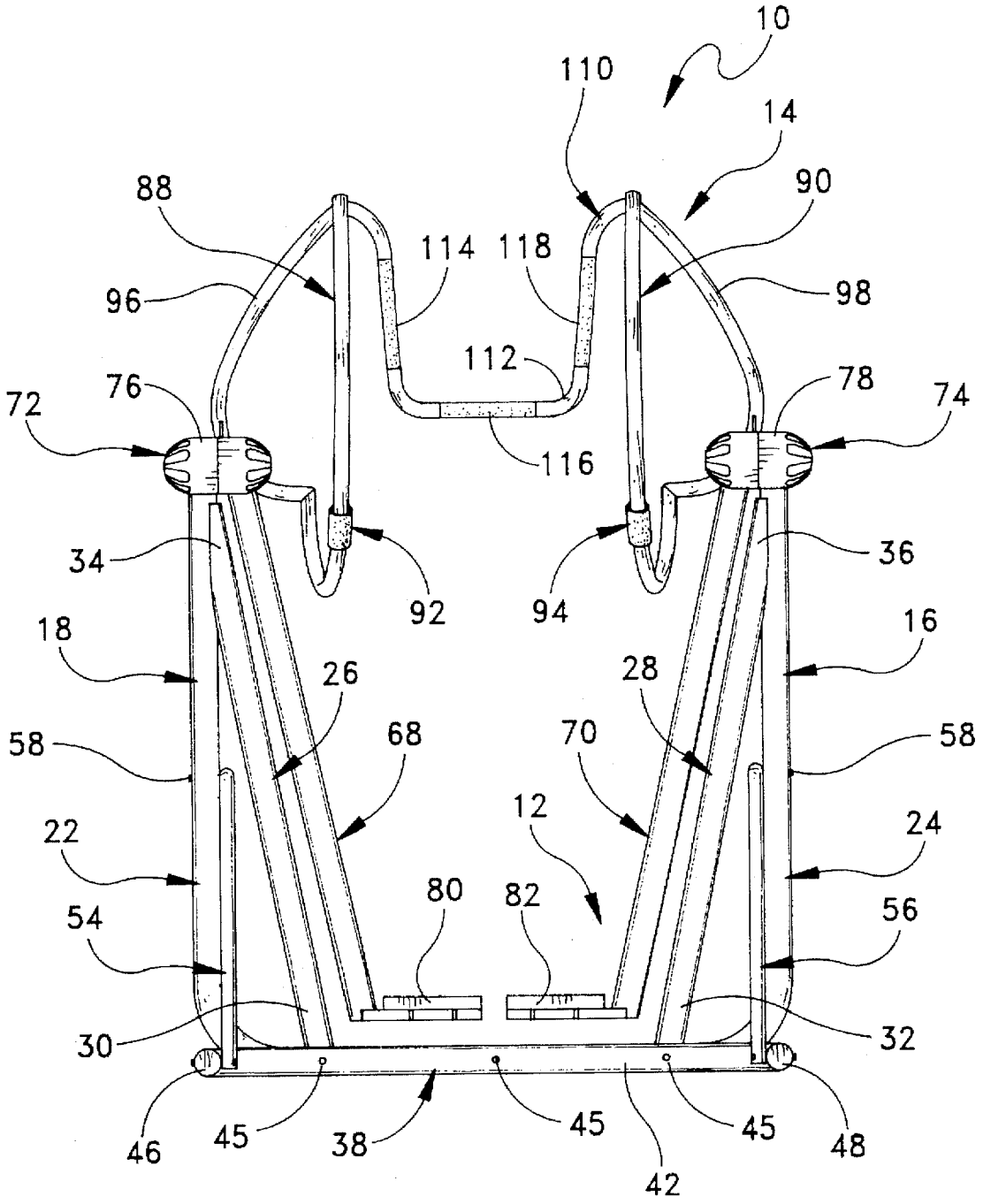
FIG. 3 is a front view thereof.
Figure 4:
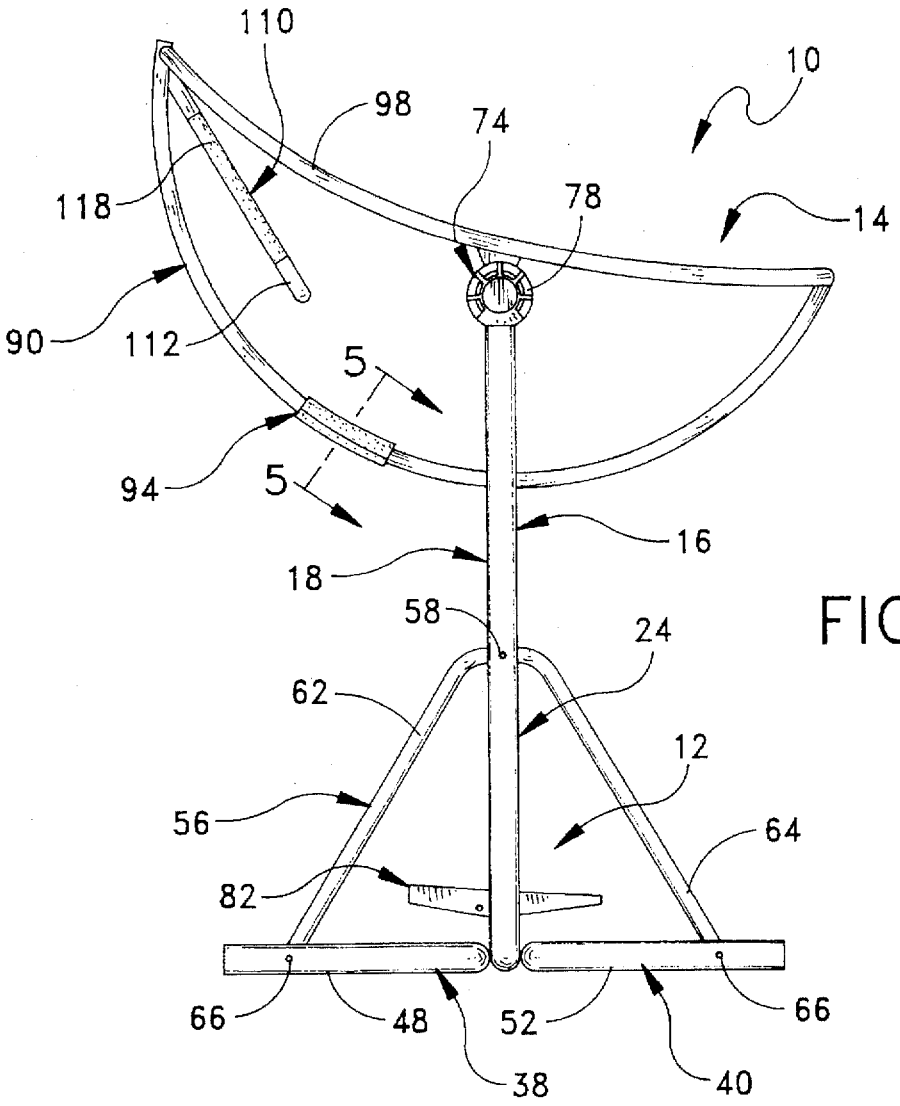
FIG. 4 is a side view thereof.
Figure 5:
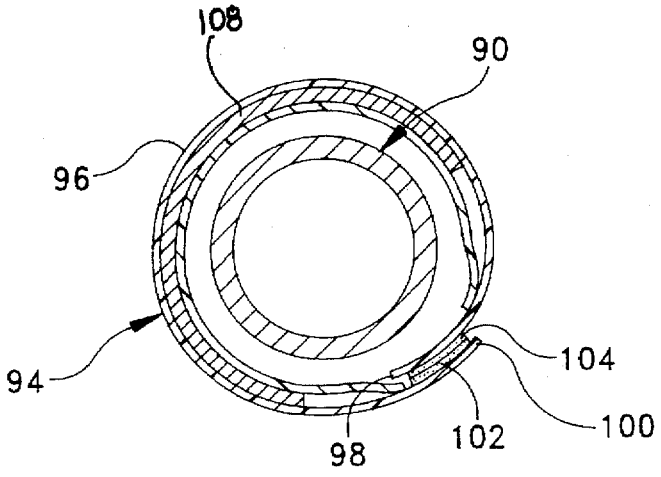
FIG. 5 is a cross-sectional view of the grip member and rail taken along line 5—5 of FIG. 4.
Figure 6:
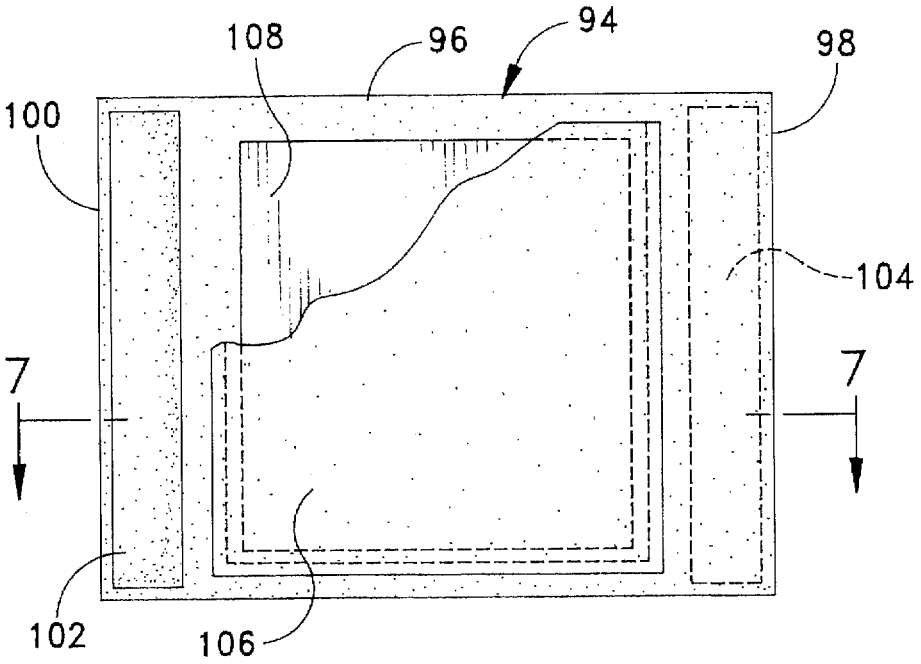
FIG. 6 is a plan view of an alternate construction of the grip member showing a pocket for receiving a sheet of weighted material.
Figure 7:
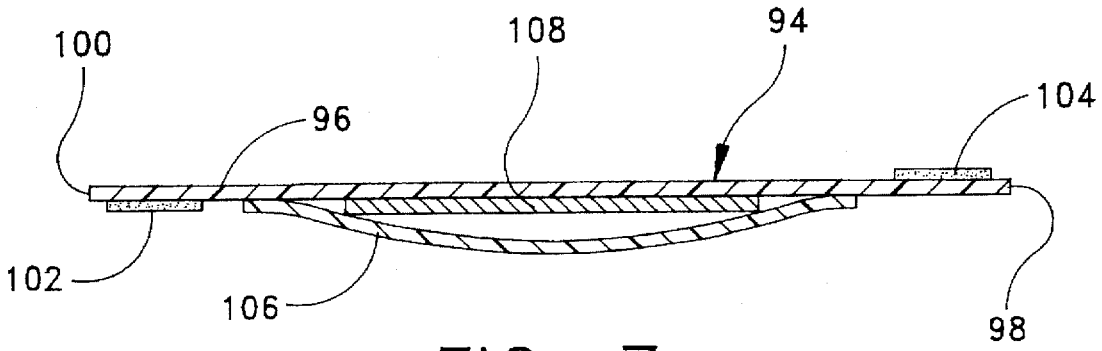
FIG. 7 is a cross-sectional view thereof taken along line 7—7 of FIG. 6.

Referring now to the drawings, the exercise apparatus of the instant invention is illustrated and generally indicated at 10 in FIGS. 1–8. As will hereinafter be more fully described, the instant exercise apparatus 10 generally comprises a lower body exercise device indicated at 12 for exercising the lower body muscle groups, and an upper body exercise device indicated 14 for exercising the upper body muscle groups.

The apparatus 10 includes a frame generally indicated at 16 for supporting the upper and lower body exercise devices 12 and 14 above a supporting surface (not shown). The frame 16 comprises a U-shaped upright support member 18 having a central body portion 20 and two spaced upright support arms 22, 24 respectively, which are sufficiently spaced for a user to stand therebetween. The upright support arms are respectively supported against relative inward movement by two angled braces 26, 28 respectively, each having a first end 30, 32 secured to the body portion 20 of the support arm 18, and a second end 34, 36 secured adjacent to the upper terminal end of the respective support arm 22, 24. The braces 26, 28 are preferably secured by welded connections, although other connection means might also be suitable. The frame 16 further comprises two U-shaped outrigger supports 38, 40 respectively each of which includes a body portion 42, 44 that is secured by fasteners 45 to the body portion 20 of the upright support 18. Each outrigger further includes a pair of spaced legs 46, 48 and 50, 52 respectively, which extend outwardly and rest on the supporting surface. The upright support 18 is further stabilized against front to rear rocking movement by two V-shaped stabilizer members 54, 56 respectively each having diverging leg members 58,60 and 62, 64 respectively. The apex of each V-shaped stabilizer member 54, 56 is secured with a fastener 58 to a mid-point of the respective support arm 22, 24 while the terminal ends of the two diverging leg members 58, 60, 62, 64 are secured by fasteners 66 to the extended legs 46, 48, 50, 52 of the respective outrigger supports 38, 40 adjacent the terminal ends thereof. Each of the structural support members 18, 26, 28, 38, 40, 54 and 56 is preferably constructed from a durable metal, or the like, in order to withstand the repeated physical stresses of repeated day to day usage. In this regard, tubular metal support members are preferred for their clean look, light weight, and structural stability. While a specific frame configuration 16 is herein described in detail, it is to be understood that a variety of different frame structures, and frame materials would be equally effective for providing a stable platform for the exercise device.

Referring now to FIGS. 1–4, the lower body exercise device preferably comprises a striding-type exerciser including two swinging leg members generally indicated at 68, 70 respectively. The upper ends of the leg members 68, 70 are each mounted to respective pivot assemblies 72, 74 respectively positioned at the upper ends of the support arms 22, 24. More specifically, a pivot pin (not shown) at the upper end of the leg member 68, 70 is rotatably received and supported in a bearing (not shown) contained within the housing 76, 78 of the respective pivot assembly 72, 74. Resistance to forward and rearward pivoting movement of the leg members 68, 70 is provided by leather friction pads (not shown) contained within the pivot assemblies 72, 74. The lower ends of the leg members 68, 70 include foot platforms 80, 82 for receiving the feet of a user and supporting the user in an upright position between the leg members 68, 70 during use. The foot platforms 80, 82 are conventional in the art, and each includes a planar stepping surface 84, 86 for receiving the foot of the user.

The upper body exercise device 14 comprises two spaced, upwardly curved rails generally indicated at 88, 90 and two grip members generally indicated at 92, 94 respectively slidably mounted on the hand rails 88, 90 for reciprocating movement thereon. Each of the rails 88, 90 is suspended above the supporting surface by means of a corresponding support rail 96, 98 which is attached in the middle thereof to the pivot assembly 72, 74, and further attached at its forward and rearward ends to the forward and rearward ends of the curved rails 88, 90. The upward curvature of the rails 88, 90 is intended to trace the swinging arc of the user's hand as the arm pivots about its shoulder joint, and in this regard, the rails 88, 90 are suspended at a point where the rails 88, 90 generally coincide with the arcuate movement of the hand. It is also contemplated that the curved rail assembly could be adjustable vertically to more accurately position the rails with respect to the height of the user, and also that the rails could be adjusted inwardly and outwardly by pivot connections at the terminal ends of each curved rail. The grip members 92, 94 are preferably formed from a soft, spun-polyester cloth material which provides for a smooth sliding action on the rails as well as providing absorbance and dissipation of sweat from the hands during use. More specifically, referring to FIGS. 4 and 5, a cross-section of rail 90 and grip member 94 is shown. The grip member 94, as well as the grip member 92, preferably comprises a generally square sheet 96 of cloth material having opposing side edges 98, 100. The grip member 94 is secured to the rail 90 by rolling the opposite side edges 98, 100 over onto each other to form a tubular configuration. The opposite side edges 98, 100 are releasably secured together by means of releasable adjustable fastening means, such as hook and pile fabric materials 102, 104, provided on the facing surfaces of the side edges 98, 100. The tubular grip members 92, 94 are then slidably movable along the length of the rails 88, 90. In order to provide a smooth gliding action of the cloth grips 92, 94 on the rails 88, 90, the rails 88, 90 preferably have a tubular steel construction with a smooth outer surface, such as provided by an enamel paint finish. Resistance to sliding movement of the grip members 92, 94 can be provided by physically squeezing the grip members 92, 94 on the rails 88, 90, or alternatively, by tightly wrapping the tubular grips 92, 94 around the rails 88, 90. Both squeezing of the grips 92, 94 and tightly wrapping the grips 92, 94 provide a user controllable level of friction resistance.

In an alternative construction (FIGS. 6 and 7), the grip member 94, may further include a pocket 106 for receiving a sheet of weighted material 108 (see also FIG. 5), or a sheet of magnetic material, each of which would be effective for providing active resistance to sliding movement of the grip members 92, 94. It is to be understood that both grips 92, 94 would have the same construction. With regard to the weighted sheet embodiment, different sheets of weighted material, each having a different weight, can be provided to increase or decrease resistance as desired. With regard to providing a sheet of magnetic material, resistance could be varied by placing additional sheets of fabric within the pocket 106 so that there is a greater amount of cloth material between the sheet of magnetic material 108 and the steel bar thereby reducing the magnetic attraction and resulting resistance. Alternatively, additional cloth grip members could be wrapped around the rail 88, 90 under the pocketed grip member 92, 94 to provide the same effect.

Referring back to FIGS. 1–4, the apparatus further includes a contoured, generally U-shaped handlebar generally indicate at 110 which is attached to, and extends between, the forward portion of the spaced rails 88, 90. The central portion 112 of the handlebar includes three padded grips 114, 116, 118 which can receive the hands of the user when the upper body exercise device 14 is not in use.

Figure 8:
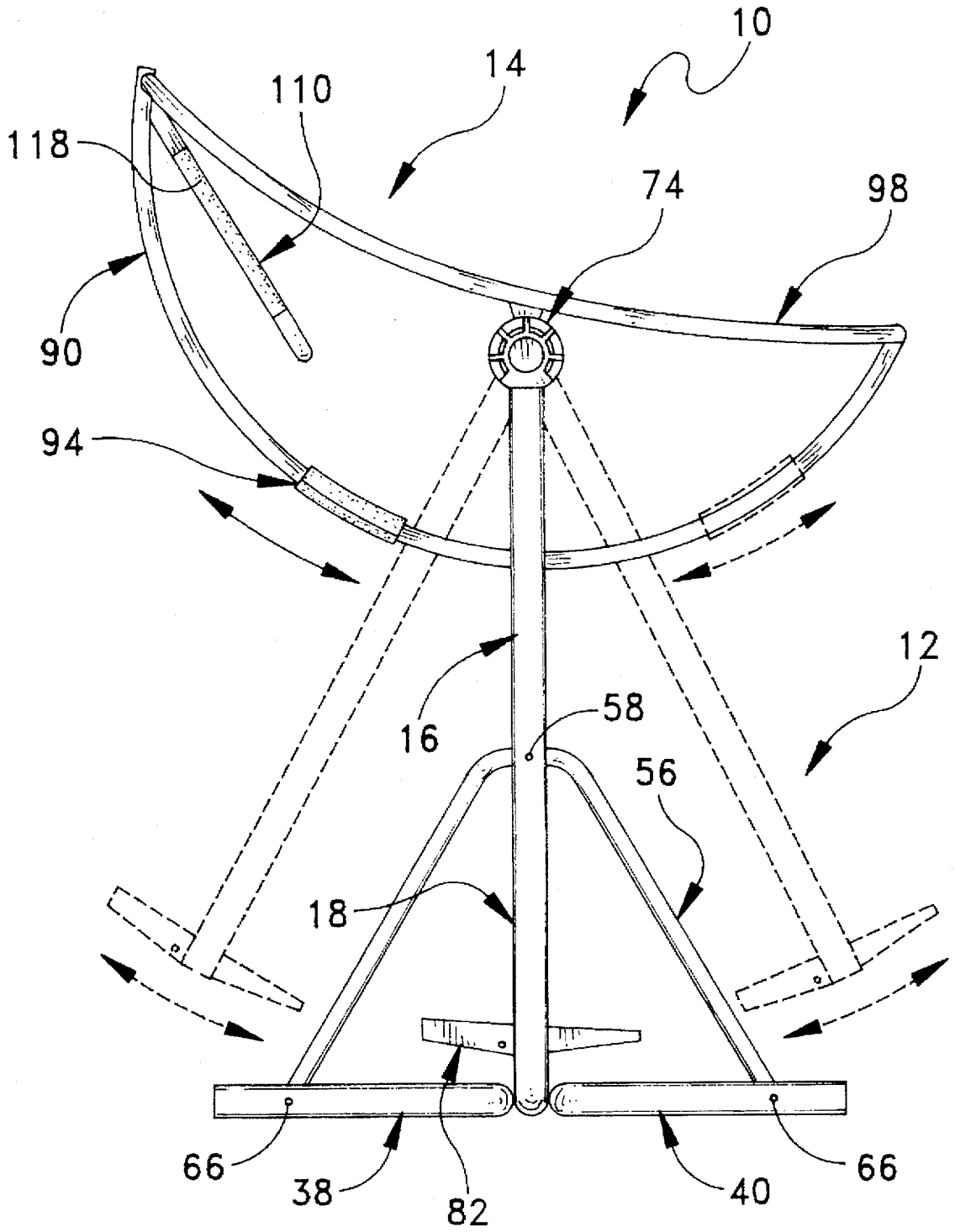
FIG. 8 is a side view of the apparatus showing pivoting articulation of the leg members and sliding movement of the grip members.

Referring now to FIG. 8, the apparatus 10 may be used in three different modes: namely, (1) both upper and lower body together (whole body striding), or (2) upper body only, or (3) lower body only. In the first mode, the user stands on the foot platforms 80, 82, grasps the grip members 92, 94 with both hands, and then moves the arms and legs in a reciprocating motion similar to the motions used when walking. For example, the right leg swings forward, and left leg swings rearward, while the right arm swings rearward and the left arm forward, and vice versa. In the second mode, (upper body only), the leg members 68, 70 can be locked in position to retain the foot platforms 80, 82 in a stationary position while the user grasps the hand grips 92, 94 and reciprocates the arms forward and rearward. In the third mode (lower body only), the user stands on the foot platforms 80, 82, grasps the handlebar 110 at the front of the apparatus 10, and reciprocates the legs forwardly and rearwardly in a striding action. It is important to note that the upper and lower body exercise devices are not interconnected by any structure as required in other striders for safety reasons, and therefore allows for more versatile exercise regimens. The independent status of each exercise further allows for a more comfortable stride balance for each individual user.

It can therefore be seen that the instant apparatus 10 provides a simple and effective exercise device which can be used in a variety of modes to achieve different exercise goals. The simple, rugged construction is cost effective to manufacture while providing the superior health benefits of much more expensive and complicated devices. The lower body striding apparatus 12 is a proven and effective device for exercising the lower body and providing significant cardiovascular benefit, while the simplified upper body apparatus 14 provides similar benefit to the upper body musculature. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An exercise apparatus comprising:

lower body exercise means for exercising lower portions of a user's body; and upper body exercise means for exercising upper portions of said user's body, said upper body exercise means comprising a pair of spaced, upwardly curved rails suspended above a supporting surface, said curved rails being sufficiently spaced for said user to stand therebetween, said upper body exercise means further comprising grip members respectively slidably mounted on each of said rails for receiving the hands of said user during use, said grip members being slidably movable along the curved length of said rails during reciprocating swinging articulation of the user's arms.

2. The exercise apparatus of claim 1 wherein said lower body exercise means comprises a striding-type lower body exercise device.

3. The exercise apparatus of claim 2 wherein said striding-type lower body exercise device comprises a pair of spaced pivotable leg members pivotally suspended above a supporting surface, said leg members being operative for reciprocating pivotable movement, said leg members being sufficiently spaced for said user to stand therebetween, said leg members each including a platform for receiving a foot of the user whereby said user can stand in an upright position between said leg members.

4. The exercise apparatus of claim 1 wherein said rails have an outer surface, and said grip members have a generally tubular construction, said tubular grip members having an inner surface which engages said outer surface of said rails, said inner surface providing a level of friction resistance to movement of said grips on the outer surface of said rails when said user is grasping and moving said grips.

5. The exercise apparatus of claim 4 wherein said grip members comprise a sheet of material having opposite side edges, said opposite side edges of said sheet being rolled over onto each other to form said tubular configuration, said opposite side edges having facing surfaces including releasable adjustable fastening means for releasably and adjustably fastening said side edges together.

6. The exercise apparatus of claim 4 wherein said grip members include a pocket for receiving a sheet of weighted material, said sheet of weighted material providing a weighted resistance to sliding movement of said grip member.

7. The exercise apparatus of claim 4 wherein said rails are formed from a metallic material, said grip members including a pocket for receiving a sheet of magnetic material, said sheet of magnetic material providing a level of magnetic resistance to movement of said grips on said rails when said user is moving said grips.

8. The exercise apparatus of claim 7 wherein said grip members further include additional sheets of material received between said sheet of magnetic material and said rail, said sheets of material being operative for reducing the magnetic force applied to said rail during movement of said grip.

9. The exercise apparatus of claim 5 wherein said grip members include a pocket for receiving a sheet of weighted material, said sheet of weighted material providing a weighted resistance to sliding movement of said grip member.

10. The exercise apparatus of claim 5 wherein said rails are formed from a metallic material, said grip members including a pocket for receiving a sheet of magnetic material, said sheet of magnetic material providing a level of magnetic resistance to movement of said grips on said rails when said user is moving said grips.

11. The exercise apparatus of claim 10 wherein said grip members further include additional sheets of material received between said sheet of magnetic material and said rail, said sheets of material being operative for reducing the magnetic force applied to said rail during movement of said grip.

12. The exercise apparatus of claim 1 further comprising handlebar means supported in front of the user for receiving the hands of the user when the upper body exercise device is not in use.

13. The exercise apparatus of claim 12 wherein said handlebar means comprises a contoured bar extending between forward portions of said spaced rails.

14. The exercise apparatus of claim 4 further comprising handlebar means supported in front of the user for receiving the hands of the user when the upper body exercise device is not in use.

15. The exercise apparatus of claim 14 wherein said handlebar means comprises a contoured bar extending between forward portions of said spaced rails.

16. An upper body exercise device for exercising upper portions of said user's body comprising:

a pair of spaced, upwardly curved rails suspended above a supporting surface, said curved rails being sufficiently spaced for said user to stand therebetween; and a pair of grip members respectively slidably mounted on each of said rails for receiving the hands of said user during use, said grip members being slidably movable along the curved length of said rails during reciprocating swinging articulation of the user's arms.

17. The exercise apparatus of claim 16 wherein said rails have an outer surface, and said grip members have a generally tubular construction, said tubular grip members having an inner surface which engages said outer surface of said rails, said inner surface providing a level of friction resistance to movement of said grips on the outer surface of said rails when said user is grasping and moving said grips.

18. The exercise apparatus of claim 17 wherein said grip members comprise a sheet of material having opposite side edges, said opposite side edges of said sheet being rolled over onto each other to form said tubular configuration, said opposite side edges having facing surfaces including releasable adjustable fastening means for releasably and adjustably fastening said side edges together.

19. The exercise apparatus of claim 17 wherein said grip members include a pocket for receiving a sheet of weighted material, said sheet of weighted material providing a weighted resistance to sliding movement of said grip member.

20. The exercise apparatus of claim 17 wherein said rails are formed from a metallic material, said grip members including a pocket for receiving a sheet of magnetic material, said sheet of magnetic material providing a level of magnetic resistance to movement of said grips on said rails when said user is moving said grips.

21. The exercise apparatus of claim 20 wherein said grip members further include additional sheets of material received between said sheet of magnetic material and said rail, said sheets of material being operative for reducing the magnetic force applied to said rail during movement of said grip.

22. The exercise apparatus of claim 18 wherein said grip members include a pocket for receiving a sheet of weighted material, said sheet of weighted material providing a weighted resistance to sliding movement of said grip member.

23. The exercise apparatus of claim 18 wherein said rails are formed from a metallic material, said grip members including a pocket for receiving a sheet of magnetic material, said sheet of magnetic material providing a level of magnetic resistance to movement of said grips on said rails when said user is moving said grips.

24. The exercise apparatus of claim 23 wherein said grip members further include additional sheets of material received between said sheet of magnetic material and said rail, said sheets of material being operative for reducing the magnetic force applied to said rail during movement of said grip.

25. The exercise apparatus of claim 16 further comprising handlebar means supported in front of the user for receiving the hands of the user when the upper body exercise device is not in use.

26. The exercise apparatus of claim 25 wherein said handlebar means comprises a contoured bar extending between forward portions of said spaced rails.

27. The exercise apparatus of claim 17 further comprising handlebar means supported in front of the user for receiving the hands of the user when the upper body exercise device is not in use.

28. The exercise apparatus of claim 27 wherein said handlebar means comprises a contoured bar extending between forward portions of said spaced rails.

* * * * *